US009805666B2

(12) United States Patent
Hoppenbrouwers et al.

(10) Patent No.: US 9,805,666 B2
(45) Date of Patent: Oct. 31, 2017

(54) LIQUID CRYSTAL DISPLAY SYSTEM AND METHOD

(75) Inventors: Jurgen Jean Louis Hoppenbrouwers, Eindhoven (NL); Martin Jacobus Johan Jak, Eindhoven (NL); Wilhelmus Henricus Maria Van Beek, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 819 days.

(21) Appl. No.: 12/513,517

(22) PCT Filed: Nov. 2, 2007

(86) PCT No.: PCT/IB2007/054442

§ 371 (c)(1),
(2), (4) Date: May 5, 2009

(87) PCT Pub. No.: WO2008/056306

PCT Pub. Date: May 15, 2008

(65) Prior Publication Data

US 2010/0060672 A1 Mar. 11, 2010

(30) Foreign Application Priority Data

Nov. 9, 2006 (EP) ..... 06123724

(51) Int. Cl.
*G09G 5/10* (2006.01)
*G09G 3/34* (2006.01)

(52) U.S. Cl.
CPC ... *G09G 3/3426* (2013.01); *G09G 2320/0646* (2013.01); *G09G 2330/021* (2013.01); *G09G 2360/16* (2013.01)

(58) Field of Classification Search
CPC ..... G09G 3/3426; G09G 2320/0646; G09G 2330/021; G09G 2360/16
USPC ..... 345/204–206, 211–215, 30, 50–55, 345/87–102
See application file for complete search history.

(56) References Cited

U.S. PATENT DOCUMENTS 7,612,758 B2 * 11/2009 Yang ..... 345/102
2001/0035853 A1 11/2001 Hoelen et al.
2004/0246275 A1 12/2004 Yoshihara et al.
(Continued)

FOREIGN PATENT DOCUMENTS

JP 2006113311 A 4/2006
JP 2006292863 A 10/2006
(Continued)

OTHER PUBLICATIONS

Seetzen et al: "High Dynamic Range Display Systems"; 9 Page Document, Proceedings of the ACM SIGGRAPH Conference, 2004, Sunnybrook Technologies, The University of British Columbia, York University.

*Primary Examiner* — Christopher E Leiby

(57) ABSTRACT

A display system (1) for generating a picture in accordance with image information (10) derived from a video signal has a light modulation device (20), an illumination device (30) and a control circuit (40) for driving both devices. The algorithm implemented in the control circuit (40) distributes the image information (10) over the light modulation device (20) and the illumination device (30) in order to minimize the power consumption of the display system.

31 Claims, 4 Drawing Sheets

(56) References Cited

U.S. PATENT DOCUMENTS

| | | | | |
|---|---|---|---|---|
| 2005/0088400 | A1 | 4/2005 | Daly et al. | |
| 2005/0184952 | A1* | 8/2005 | Konno et al. | 345/102 |
| 2005/0200295 | A1 | 9/2005 | Lim et al. | |
| 2006/0125771 | A1* | 6/2006 | Inuzuka et al. | 345/102 |
| 2006/0238485 | A1 | 10/2006 | Yang | |
| 2010/0060672 | A1 | 3/2010 | Hoppenbrouwers et al. | |

FOREIGN PATENT DOCUMENTS

| | | | |
|---|---|---|---|
| WO | 03034719 | A1 | 4/2003 |
| WO | 2005093703 | A1 | 10/2005 |
| WO | 2005119639 | A1 | 12/2005 |
| WO | 2006040737 | A1 | 4/2006 |

* cited by examiner

LIQUID CRYSTAL DISPLAY SYSTEM AND METHOD

FIELD OF THE INVENTION

The invention relates to a display system for generating a picture in accordance with image information derived from a video signal, comprising a light modulation device, an illumination device for illuminating the light modulation device and a control circuit for driving both the light modulation device and the illumination device. Such display systems are used in particular in TV sets, (portable) computers, in-vehicle navigation systems, medical imaging viewers and in datagraphic displays in process control rooms.

The invention also relates to a method to minimize the power consumption of a display system for generating a picture in accordance with image information derived from a video signal, the system comprising a light modulation device, an illumination device for illuminating the light modulation device and a control circuit for driving both the light modulation device and the illumination device.

BACKGROUND OF THE INVENTION

Display systems of the kind set forth are well known. They belong to the so-called non-luminous display types, of which a well-known example is the Liquid Crystal Display device.

In these LCD devices the light modulation device consists of a pixilated panel comprising liquid crystal (LC) elements functioning as a variable transmission filter. The illumination device (also known as the backlight unit) comprises light source means. Generally, these are low-pressure mercury vapor discharge lamps. Recently, however, LED based backlight units have been described.

One of the technical challenges with electrical devices in general and display systems in particular is the minimization of the overall power consumption of the device.

Seetzen et al. describe in '*High Dynamic Range Display Systems*' (Proceedings of ACM SIGGRAPH conference 2004) a display system based on the fundamental idea of using a 'first display', i.e. an LCD panel, as an optical filter with a programmable transparency to modulate a high intensity but low-resolution image from a 'second display'. This 'second display' being an array of LEDs, the intensity of which can be programmed individually. Thus their display system generates a picture in accordance with image information derived from a video signal by distributing said image information over the 'first' and 'second' displays. More precisely, it is suggested that optimally the image information derived from the video signal is distributed evenly over the LCD light modulation device and the LED illumination device. This choice of a 50%/50% distribution is inspired by considerations with respect to rounding errors. A drawback of the solution described by Seetzen et al. is that the overall power consumption of the display system is still relatively high. Therefore, they do not solve the technical challenge of minimizing the overall power consumption of display systems of the kind set forth.

SUMMARY OF THE INVENTION

It is an object of the invention to provide a solution for the technical challenge to minimize the power consumption of display systems comprising a backlight unit and a light modulation device. This objective is achieved by providing a display system in accordance to claim 1 and a method in accordance to claim 5.

According to a first aspect the invention provides a display system for generating a picture in accordance with image information derived from a video signal, comprising a light modulation device having a multitude of pixels with variable transmission, an illumination device for illuminating the light modulation device, a control circuit, for driving both the light modulation device and the illumination device, the light modulation device, when in operation, having at least one region in which a pixel $P_{Lregionmax,i}$ exhibits the largest luminance in accordance with the image information for said region, characterized in that the control circuit is arranged to distribute the image information over the light modulation device and the illumination device by setting the transmission of pixel $P_{Lregionmax,i}$ to its maximum, setting the luminance $L_{BL,i}$ of the illumination device behind said region in accordance with the luminance of pixel $P_{Lregionmax,i}$ adjusting the transmission of the other pixels in said region in accordance with the image information and $L_{BL,i}$.

The advantage of the present invention lies in the fact that the control circuit is arranged to distribute the image information over the light modulation device and the illumination device unequally. If chosen correctly, the unequal distribution of the image information can cause the combined power consumption of the light modulation device and the illumination device to be lower than with an equal distribution. The invention is based on the recognition that Seetzen et al. did not realize that the even distribution of the image information is sub-optimal from an overall system power consumption point of view.

According to an embodiment the control circuit is arranged to distribute the image information over the light modulation device and the illumination device dependent on the luminance level $L_{pic,regionmax,i}$ exhibited by $P_{Lregionmax,i}$ as defined in claim 2. Thus, in an embodiment the display system for generating a picture in accordance with image information derived from a video signal, comprising a light modulation device having a multitude of pixels with variable transmission, an illumination device for illuminating the light modulation device, a control circuit for driving both the light modulation device and the illumination device, the light modulation device, when in operation, having at least one region in which a pixel $P_{Lregionmax,i}$ exhibits a luminance $L_{pic,regionmax,i}$ and having a pixel $P_{Lmax}$ exhibiting the largest luminance $L_{pic,max}$ of the display system in accordance with the image information, characterized in that the control circuit is arranged to distribute the image information over the light modulation device and the illumination device by (i) selecting a parameter a from the range $\frac{1}{2}<a\leq 1$ dependent on the luminance level(s) $L_{pic,regionmax,i}$, (ii) setting the luminance $L_{BL,i}$ of the illumination device behind said at least one region according to the formula $$L_{BL,i} = L_{pic,max} \times \left[\frac{L_{pic,region\ max,i}}{L_{pic,max}}\right]^a,$$

(iii) adjusting the transmission of the other pixels in said region in accordance with the image information and $L_{BL,i}$. This embodiment is beneficial to minimize rounding errors in very dark areas of the picture as well as for safeguarding a seamless luminance match at the border of adjacent regions of the light modulation device.

According to an embodiment the control circuit is arranged to keep the transmission of $P_{Lregionmax,i}$ at its maximum for luminance levels $L_{pic,regionmax,i}$ above a predetermined threshold as defined by claim 3.

According to an embodiment the predetermined threshold level is chosen to lie in the range 2%-10% of the maximum $L_{pic,max}$ achievable on the display system.

According to a second aspect the invention provides a method to minimize a power consumption of a display system for generating a picture in accordance with image information derived from a video signal, the display system comprising a light modulation device having a multitude of pixels with variable transmission, an illumination device for illuminating the light modulation device, a control circuit, for driving both the light modulation device and the illumination device, the method comprising the step of distributing the image information over the light modulation device and the illumination device by: (i) dividing the light modulation device in at least one region, (ii) determining for each of the at least one regions a pixel $P_{Lregionmax,i}$ exhibiting the largest luminance $L_{pic,regionmax,i}$, (iii) setting the transmission of each pixel $P_{Lregionmax,i}$ to its maximum, (iv) setting the luminance $L_{BL,i}$ of the illumination device behind each of said regions in accordance with $L_{pic,regionmax,i}$, (v) adjusting the transmission of the other pixels in each of said regions in accordance with the image information and $L_{BL,i}$.

These and other aspects of the invention will be apparent from and elucidated with reference to the embodiments described hereinafter.

Other Prior Art

In US20010035853 an assembly of the kind set forth is disclosed, wherein the backlight unit comprises an array of LEDs of at least two different colors. In order to improve the contrast of the final picture, it is disclosed that the intensity of the LEDs can be controlled on a frame-by-frame basis. Especially the contrast in dark scenes can be improved in this manner, because the lowered backlight luminance reduces the light leakage through the LCD panel. Although the power consumption of the device will be lower when the LEDs are dimmed in dark scenes compared to an undimmed situation, US20010035853 does not teach to solve the technical challenge of minimizing the power consumption of display systems of the kind set forth irrespective of the content of the picture to be generated by the display system.

Furthermore, US20050184952 discloses a similar apparatus wherein the backlight unit is driven in units (i.e. in sequence of individual plural light source partitive areas) and the luminance of these areas in the backlight unit is controlled in accordance with the image information derived from a video signal. One objective of this technique of controlling the luminance of the backlight unit is power consumption reduction. However, the main focus of US20050184952 lies in disclosing a technique to maintain the picture quality in combination with a reduction of the power consumption and to realize a video display apparatus and method capable of widening the display luminance range and raising the contrast ratio without degrading the picture quality. As the teachings in US20050184952 are clearly focused on maintaining a good picture quality and contrast ratio when the image information is distributed over the backlight unit and the light modulation device, it does not teach anything on the achievable reduction in power consumption, let alone that US20050184952 solves the technical challenge of minimizing the power consumption of display systems of the kind set forth irrespective of the content of the picture to be generated by the display system.

BRIEF DESCRIPTION OF THE DRAWINGS

Further details, features and advantages of the invention are disclosed in the following description of exemplary and preferred embodiments in connection with the drawings.

DETAILED DESCRIPTION OF THE EMBODIMENTS

Figure 1:
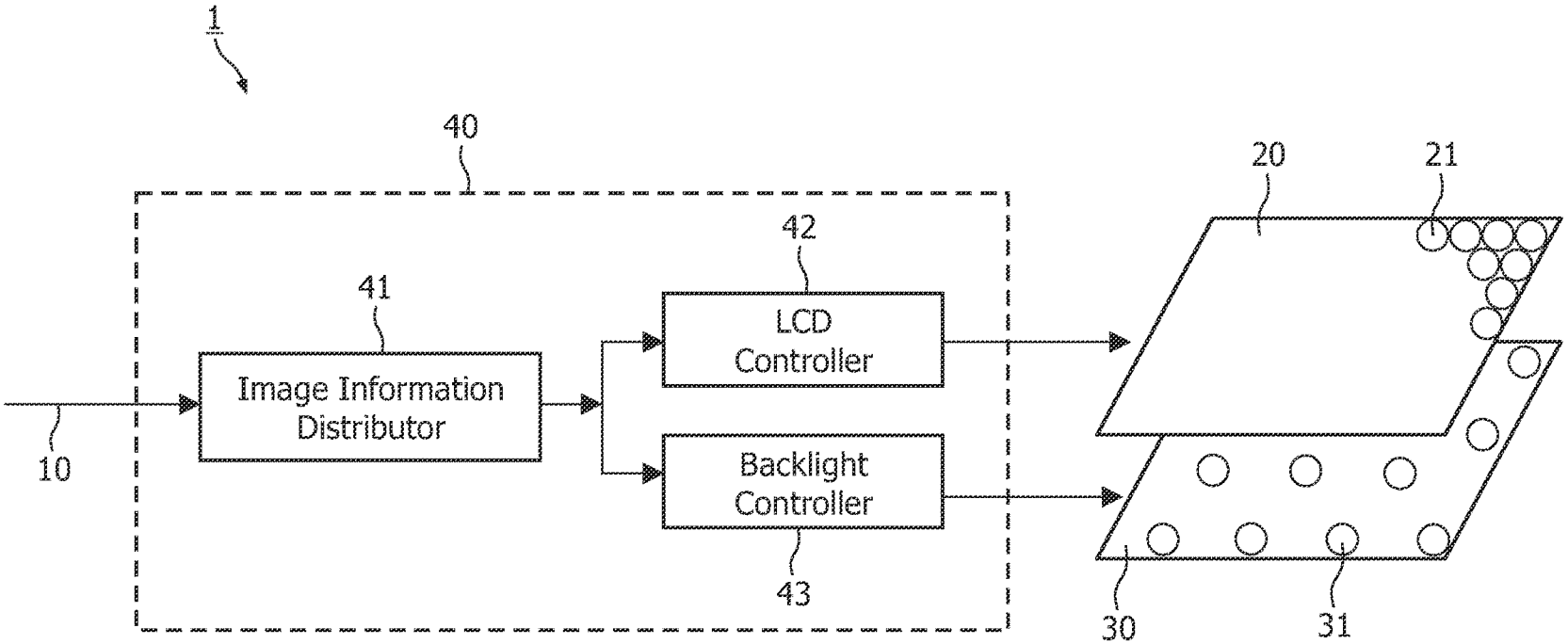
FIG. 1 shows schematically a display system of the kind set forth.

FIG. 1 shows schematically a display system 1 for generating a picture in accordance with image information 10 derived from a video signal, comprising a light modulation device 20, an illumination device 30 for illuminating the light modulation device and a control circuit 40 for driving both the light modulation device and the illumination device. Such a display system is known from prior art.

The light modulation device 20 is conveniently chosen to be a liquid crystal (LC) panel having a multitude of pixels 21 with a variable transmission, while the illumination device 30 is conveniently equipped with an array of LEDs 31. The amount of LEDs 31 in the array depends on the power characteristics of these LEDs and the requirements for the display system set by the designer. For 1 W white LEDs 31 the array has typically a pitch distance of about 1-10 cm. Depending on the content of the picture to be displayed, the luminance of the LEDs 31 is controlled individually. As a result a display system 1 with a high dynamic range can be realized due to the fact that the light leakage that is usually present—even when the LC pixels 21 in the panel 20 are set to 'black', i.e. minimal transmission, the light from the backlight is not completely blocked—can be reduced in dark areas of the picture by dimming the corresponding LEDs 31 in the array of the backlight unit 30. Now that the luminance of the LEDs 31 is controlled individually, the information to the LC panel 20 has to be adjusted in order to safeguard the proper picture content presented to the viewer. The control circuit 40 achieves this through an image information distributor 41, which supplies part of the image information to the backlight controller 43 and the remainder to the LCD controller 42. The later two controllers drive the backlight unit 30 and the LC panel 20, respectively.

Figure 2:
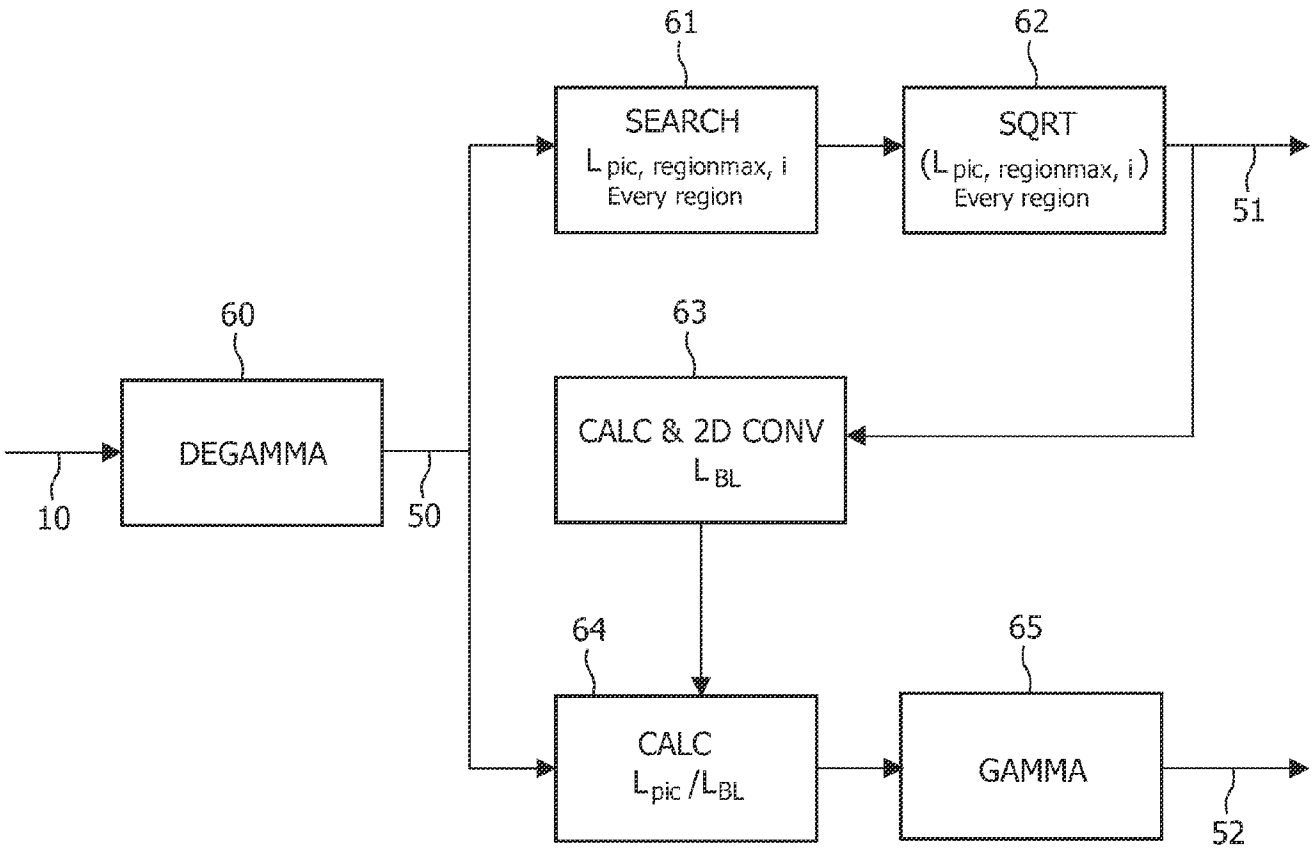
FIG. 2 (PRIOR ART)
FIG. 2 shows the video-processing algorithm used to determine the drive level of both the backlight unit and the LC panel according to the prior art.

The algorithm applied by Seetzen et al., as schematically shown in FIG. 2, can be described to function as follows. Defining the luminance of the image information derived from the video signal as $L_{pic}$ 50. Defining also the luminance at the front of the display screen as $L_{FoS}$, it can be deduced that this can be expressed as $$L_{FoS}=L_{BL}\times T_{LCD},$$

where $L_{BL}$ is the luminance of the LEDs in the backlight unit 30 and $T_{LCD}$ is the transmission of the elements in the LC panel 20. In order to safeguard the proper presentation of the picture to the viewer $L_{FoS}$ should be equal to the luminance of the picture $L_{pic}$ 50 as defined by the video signal. It is clear to the person skilled in the art that this relation should hold for every pixel in the display.

Due to the fact that the number of LEDs 31 in the array of the backlight unit 30 is considerably smaller than the number of pixels 21, i.e. LC elements, in the panel 20, there is no one-to-one correspondence between a single LED and a single LC element. As an example, Seetzen et al. describe a display system 1 containing as much as 760 1 W white LumiLED Luxeon LEDs in the backlight unit 30 arranged in a hexagonal close-packed array, while their 18-inch LG-Philips LC panel 20 has a 1280×1024 resolution. This set-up results in a very high dynamic range display system, which is advantageous in f.i. medical imaging viewers. For consumer applications, a 32-inch LCD display system 1 with a typical 1368×768 resolution typically contains ~150 1 W white LEDs 31.

However, a correspondence can be made between each pixel 21 and its nearest LED 31. Consequently, a multitude of regions can be defined in the light modulation device 20, where the $i^{th}$ region comprises all the pixels 21 closest to the $i^{th}$ LED 31. It is noted that a one-on-one correspondence of the regions and the LEDs is not essential to the invention. Therefore, alternatively, a correspondence can be made between all the pixels 21 in a region and several LEDs 31 located behind that region. The LED-drive values are consequently chosen according to the maximum luminance level $L_{pic,regionmax,i}$ that is present in the $i^{th}$ region of the picture around the corresponding LED(s). $P_{Lregionmax,i}$ indicates the pixel displaying this maximum luminance level in said region. This maximum luminance level is determined in block 61 of the algorithm and is indicative of the maximum amount of light that must be displayed at that specific region of the picture. Therefore it is also indicative of the drive value of the corresponding LED(s). It is noted that obviously there is at least one region exhibiting the largest luminance level $L_{pic,max}$ of the entire display system, corresponding to pixel $P_{Lmax}$.

Considering that rounding errors should be minimal, Seetzen et al. distributed the image information over the LC panel 20 and the LED backlight unit 30 on a 50%/50% basis. Block 62 implements this distribution to obtain the luminance $L_{BL,i}$ 51 of the LED(s) behind the $i^{th}$ region in the backlight unit 30 corresponding to the region by using the formula $$L_{BL,i} = L_{pic,max} \times \sqrt{\left[\frac{L_{pic,region\ max,i}}{L_{pic,max}}\right]}$$

The algorithm relies on the LC panel 20 to compensate for any difference between the luminance of the target picture $L_{pic,i}$ and $L_{BL,i}$ 51. To derive at the drive values of the LC elements in the panel 20, the lack of one-on-one correspondence has to be taken into account. Therefore a 2D convolution is performed in block 63 to arrive at the overall backlight unit luminance profile $L_{BL}$. Basically, the luminance of the backlight at each LCD pixel position is calculated. Subsequently, $L_{BL}$ is divided out of the luminance profile of the original picture (block 64), to obtain the transmission characteristic $T_{LCD}$ 52 of (all the pixels in) the LC panel 20. In order to correct for the non-linear characteristics of the display system, degamma 60 and gamma 65 functions are applied. The display system (de-)gamma functions are conveniently implemented using a Look-Up-Table in the memory of the control circuit 40. The application of these functions ensures that the calculations determining the transmission characteristics of the LC elements can be performed in the linear luminance domain. The person skilled in the art will appreciate that the light output of the LEDs is linearly dependent on the current and therefore no gamma function has to be applied in that part of the algorithm. Finally, it should be noted that the first part of the algorithm—i.e. the upper blocks 61, 62 in FIG. 2—is applied on a LED resolution basis, while the second part of the algorithm—i.e. the lower blocks 64, 65—is applied on an LCD pixel resolution basis.

Again, it is to be stressed that the square root function applied by Seetzen et al. essentially distributes the image information equally over the illumination device and the light modulation device. A drawback of the solution is that the overall power consumption of the display system is still relatively high. As a result they do not solve the technical challenge of minimizing the overall power consumption of display systems of the kind set forth.

It is recognized that Seetzen et al. were inspired by considerations with respect to rounding errors. However, eventual rounding errors can be compensated for by proper signal processing algorithms known in the art, like dithering or error diffusion.

This invention provides a solution for the technical challenge to minimize the power consumption of display systems comprising a backlight unit and a light modulation device. This objective is achieved by providing a display system 1 for generating a picture in accordance with image information 10 derived from a video signal, comprising a light modulation device 20, an illumination device 30 for illuminating the light modulation device, a control circuit 40 for driving both the light modulation device and the illumination device, wherein the control circuit 40 is arranged to distribute the image information 10 over the light modulation device 20 and the illumination device 30 such that the overall power consumption of the display system is minimized.

It is recognized that almost all power in the display system 1 is consumed in the backlight unit 30. Compared to this, the power consumption of the LC panel 20 is relatively small. For example, in a commercially available 30-inch LCD module from LG-Philips the LC panel 20 consumes about 5 W, while the TL based backlight unit 30 consumes about 100 W. Furthermore, the LC panel power consumption is essentially independent of its transparency. Moreover, it is well noted that the absolute transparency is limited to about 3-8%, even when the LC panel 20 is switched to 'white', i.e. maximum transmission. From a power consumption efficiency point of view it is therefore preferable to maintain the transparency of the LC panel at its maximum level whenever possible.

Figure 3:
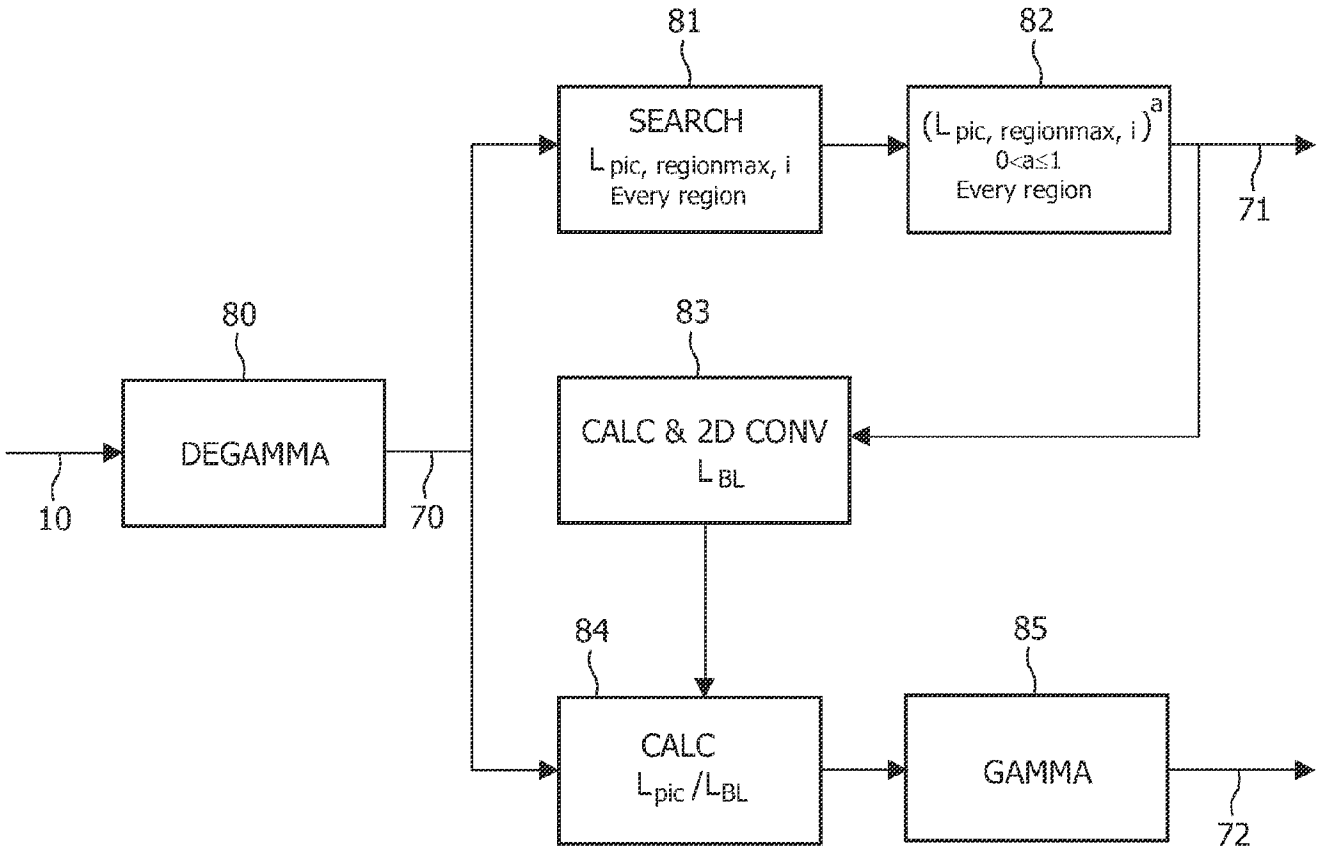
FIG. 3 shows an embodiment of the optimized video-processing algorithm used to determine the drive level of both the backlight unit and the LC panel according to the present invention.

Implemented in an embodiment according to the present invention is the optimized video processing algorithm as shown in FIG. 3. It runs along the same line as the one described in FIG. 2, except that the distribution of the image information is now implemented in block 82 using the formula $$L_{BL,i} = L_{pic,max} \times \left[\frac{L_{pic,region\ max,i}}{L_{pic,max}}\right]^{a},$$

with ½<a≤1. Even more general, with 0≤a≤1. The algorithm reduces to that of Seetzen et al. in case a equals ½. Furthermore, it reduces to the classical case with no image information directed to the backlight unit 30 in case a equals 0.

The efficiency improvement becomes readily apparent when 3 display systems are considered, characterized by respectively a=0, a=½ and a~1 (see Table 1). The first one is the classical case where no image information is directed to the backlight unit 30. This backlight unit then operates at a fixed rating, which essentially is determined by the peak brightness achievable by the display system 1 and the maximum transparency setting of the LC panel 20. A typical commercial 30-inch LCD TV equipped with 16 6.25 W narrow diameter fluorescent tubes is an example of such a system. The tubes typically have an efficacy of 60 lm/W and the backlight unit as a whole typically has a luminance of 10000 Nits, achieving an average Front-of-Screen luminance of typically 125 Nits. The (average) transparency of the LC panel 20 is then about 1.25%, equivalent to about 25% of the maximum transparency. A similar performance can be obtained when the backlight unit 30 is equipped with LEDs, which in this case (i.e. a=0) are not individually addressed. It is noted that at present commercially available 1 W white LEDs have an efficacy of about 30 lm/W. However, in view of the proclaimed technology/product roadmap of LED manufacturers, 60 lm/W white LEDs will be come available in due course. In discussing the energy efficiency improvement in comparison with the other two display systems, we assume that they are equipped with these later (more efficient) LEDs.

The second display system, characterized by a=½, is the one proposed by Seetzen et al. To achieve the same average FoS (front of screen) luminance at 125 Nits, only 50% of the amount of light needs to be generated by the backlight unit 30, as the (average) transparency of the LC panel 20 is increased on average to 2.5%. An overall power consumption reduction of 50 W, or about 48%, is obtained relative to the classical case.

This however is not the most energy efficient implementation of the distribution of the image information. When the image information derived from the video signal is distributed in such a way that the transparency of the LC panel 20 is kept at its maximum where ever possible within the target luminance profile of the picture $L_{pic}$ 50, i.e. in case a=1, the power consumption of the backlight unit 30 can be reduced even further. Again, considering an average front of screen luminance $L_{FoS}$ of 125 Nits the average backlight unit luminance $L_{BL}$ can be reduced to some 2500 Nits in combination with an average 5% transparency of the LC panel 20. This results in an overall power consumption of 30 W, thus realizing a reduction of an astonishing 71%.

TABLE 1

Energy efficiency comparison LCD display systems

| | a = 0 | a = ½ | a = 1 |
|---|---|---|---|
| $P_{BL}$ [W] | 100 | 50 | 25 |
| $P_{LCD}$ [W] | 5 | 5 | 5 |
| $P_{Total}$ [W] | 105 | 55 | 30 |
| $L_{BL}$ [Nit] | 10000 | 5000 | 2500 |
| $T_{LCD}$ [%] | 1.25 | 2.5 | 5 |
| $L_{FoS}$ [Nit] | 125 | 125 | 125 |

Although it was indicated above that the rounding errors could be compensated by proper signal processing algorithms like dithering or error diffusion, it is still possible that very dark image areas, i.e. areas that contain drive levels near 'black', may cause problems. The main cause of these problems lies in the fact that for such areas the luminance of the LEDs 31 is very low while the transmission of the LC elements 21 is near maximum. Rounding errors are then visible as noise, while at the same time the always-present noise level in the input video signal gets amplified. Such rounding errors are usually the largest for a near 0 or near 1.

Therefore, in an embodiment of the invention the distribution of the image information over the light modulation device 20 and the illumination device 30, i.e. the factor a, is dependent on the luminance level of the picture $L_{pic}$ 50. In other words, the factor a will be different for every region, and may be determined f.i. by $L_{pic,regionmax,i}$. In an effort to minimize these residual rounding errors, it has been found that it is advantageous for $L_{pic}$ 50 luminance levels above a predetermined threshold to choose the distribution factor a nearly equal—and preferably equal—to 1, while for luminance levels below this threshold a is preferably chosen to be smaller. An example of such a luminance level dependent choice of the distribution factor a is given in Table 2. Here, $L_{pic}$ 50 is characterized by an 8-bit value, running from 0 ('black') to 255 ('white'). It is noted that a threshold a $L_{pic}$=10 (~4% of the largest achievable value) in fact corresponds with a Front-of Screen of about 20% of the maximum achievable by the display system due to the non-linear characteristic of the system.

TABLE 2

Distribution factor dependence on input luminance level

| Luminance level $L_{pic}$ | Distribution factor a |
|---|---|
| 0-5 | 0.5 |
| 6 | 0.6 |
| 7 | 0.7 |
| 8 | 0.8 |
| 9 | 0.9 |
| 10-255 | 1.0 |

Figure 4:
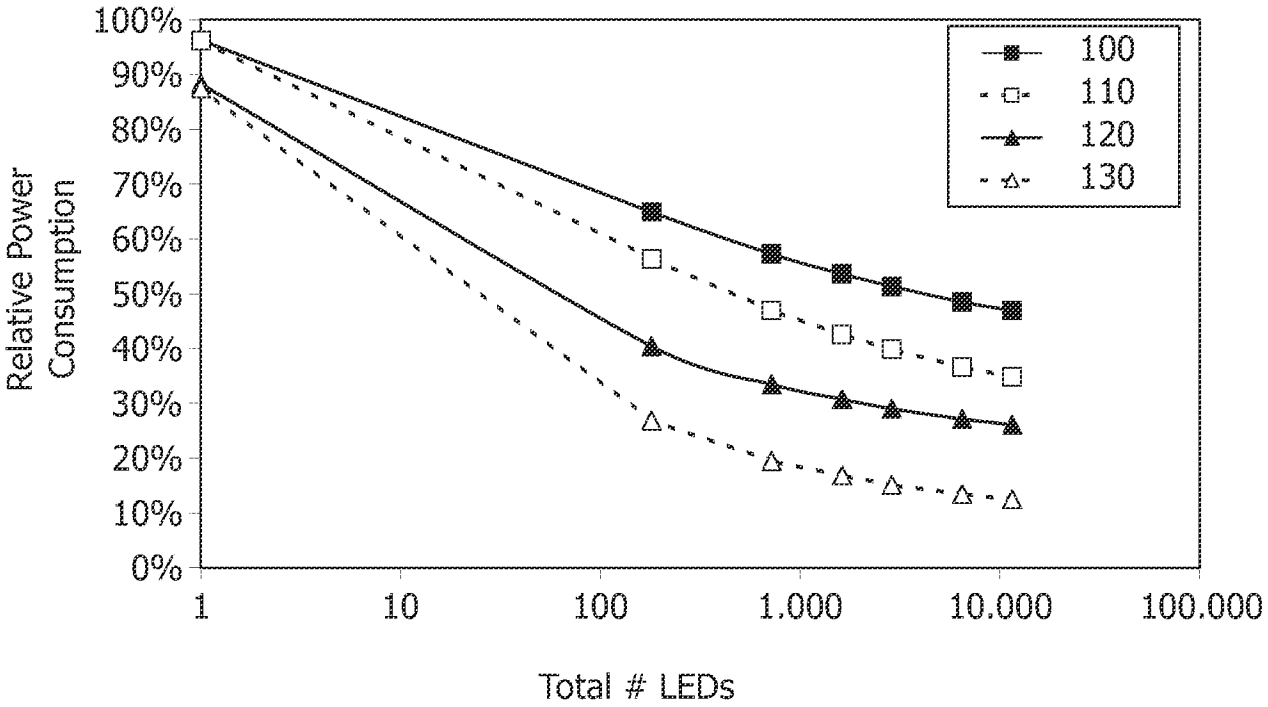
FIG. 4 shows the relative power consumption of a LED based LCD display system as a function of the algorithm implemented.

A display system 1 according to the invention has been built and the attainable power consumption reduction has been measured as a function of both the number of individually addressed LEDs 31 present in the backlight unit 30 and the algorithm implemented. The result is shown in FIG. 4. Here the relative power consumption is shown based on a statistical analysis of a collection of images with TV and DVD quality, respectively. The dark squares and solid line 100 are representative for TV images in combination with the algorithm as described by Seetzen et al., i.e. with a distribution factor a=½. The open squares and dotted line 110 are representative for TV images in combination with the optimal algorithm according to the invention (with the choice of the distribution factor a according to Table 2) that minimizes the power consumption of the display system 1. Similarly, the dark triangles and solid line 120 are representative for DVD images in combination with the Seetzen algorithm; while the open triangles and dotted line 130 are representative for DVD images in combination with the optimal algorithm according to this invention. Both TV and DVD data show a clear reduction of the power consumption when the number of LEDs is increased. The person skilled in the art will understand that there is a saturation level equivalent to the situation of a one-on-one relation between a LED and a LC cell. In this limit there will be no need for the LC panel 30, as the backlight unit 20 can provide all the image information.

Although the invention has been elucidated with reference to the embodiments described above, it will be evident that other embodiments may be alternatively used to achieve the same object. The scope of the invention is therefore not limited to the embodiments described above, but can also be applied to any other display device such as, for example, where the algorithm is applied to a subset of the LEDs in the backlight unit or a subset of temporally successive video frames. Alternatively, the algorithm can be applied for each color separately when red, green and blue LEDs are used in the backlight unit 20 in stead of phosphor coated white LEDs. As a result, in this later case, each color will be adjusted individually.

It should further be noted that use of the verb "comprises/comprising" and its conjugations in this specification, including the claims, is understood to specify the presence of stated features, integers, steps or components, but does not exclude the presence or addition of one or more other features, integers, steps, components or groups thereof. It should also be noted that the indefinite article "a" or "an" preceding an element in a claim does not exclude the presence of a plurality of such elements. Moreover, any reference sign does not limit the scope of the claims; the invention can be implemented by means of both hardware and software, and several "means" may be represented by the same item of hardware. Furthermore, the invention resides in each and every novel feature or combination of features.

The invention claimed is:

1. A method for displaying image information in a display system comprising:

determining, from the image information, a maximum pixel luminance in a region of a light modulation device, wherein a light source of an illumination device is configured to illuminate the region of the light modulation device;

selecting a distribution factor based on a predetermined distribution factor function that is configured to select a given distribution factor for a plurality of pixel luminances below a predetermined maximum pixel luminance and is configured to select which one of a plurality of distribution factors larger than the given distribution factor corresponds to the maximum pixel luminance when the maximum pixel luminance is above the predetermined maximum pixel luminance;

calculating a luminance of the light source by applying the selected distribution factor to the maximum pixel luminance and calculating a transmission of the light modulation device for a pixel corresponding to the maximum pixel luminance; and displaying the maximum pixel luminance at the pixel by configuring the light source of the illumination device to output said luminance of the light source and by configuring the light modulation device to implement the calculated transmission at the pixel.

2. The method of claim 1, wherein the light source is a first light source, wherein the region of the light modulation device is a first region, wherein the maximum pixel luminance is a first maximum pixel luminance, wherein the luminance of the light source is a first light source luminance and wherein the method further comprises:

selecting a second distribution factor, which corresponds to a second maximum pixel luminance in a second region of the light modulation device, based on the predetermined distribution factor function, wherein the second distribution factor is different from the first distribution factor;

calculating a second light source luminance of a second light source of the illumination system that is configured to illuminate the second region by applying the selected second distribution factor to the second maximum pixel luminance and calculating a second transmission of the light modulation device for an other pixel corresponding to the second maximum pixel luminance, wherein the displaying further comprises displaying the second maximum pixel luminance at the other pixel by configuring the second light source of the illumination device to output said second light source luminance and by configuring the light modulation device to implement the calculated second transmission at the other pixel.

3. The method of claim 1, wherein the applying the selected distribution factor to the maximum pixel luminance comprises scaling a contribution of the maximum pixel luminance to the luminance of the light source with the selected distribution factor.

4. The method of claim 1, wherein the calculating the luminance of the light source and the function are configured such that the luminance of the light source increases with increasing values of the maximum pixel luminance for at least a subset of the plurality of distribution factors.

5. The method of claim 1, wherein the applying comprises applying the selected distribution factor as a power of a fraction of the maximum pixel luminance.

6. The method of claim 1, wherein the applying comprises applying the selected distribution factor as a power of Lr/Lp, wherein Lr is the maximum pixel luminance in said region of the light modulation device and wherein Lp is a maximum pixel luminance of all regions in the light modulation device.

7. The method of claim 5, wherein the applying comprises applying the distribution factor as:

$$\left(\frac{L_r}{L_p}\right)^a,$$

wherein Lr is the maximum pixel luminance in said region of the light modulation device, Lp is a maximum pixel luminance of all regions in the light modulation device, and a is the distribution factor.

8. The method of claim 1, wherein a majority of distribution factor variances in said function occur only for a subrange of pixel luminances displayable by the light source.

9. The method of claim 8, wherein a substantial majority of said pixel luminances displayable by the light source are outside of said subrange.

10. The method of claim 9, wherein said substantial majority of said pixel luminances is at least about 98% of said pixel luminances displayable by the light source.

11. A system for displaying image information comprising:

a light modulation device including a pixel region;

an illumination device including a light source that is configured to illuminate the pixel region of the light modulation device; and a control circuit configured to determine, from the image information, a maximum pixel luminance in the pixel region of the light modulation device, select a distribution factor based on a predetermined distribution factor function that is configured to select a given distribution factor for a plurality of pixel luminances below a predetermined maximum pixel luminance and is configured to select which one of a plurality of distribution factors larger than the given distribution factor corresponds to the maximum pixel luminance when the maximum pixel luminance is above the predetermined maximum pixel luminance, calculate a luminance of the light source by applying the selected distribution factor to the maximum pixel luminance and calculate a transmission of the light modulation device for a pixel corresponding to the maximum pixel luminance, and configure the light source of the illumination device to output said luminance of the light source and configure the light modulation device to implement the calculated transmission at the pixel such that the maximum pixel luminance is displayed at the pixel.

12. The system of claim 11, wherein the light source is a first light source, wherein the pixel region of the light modulation device is a first region, wherein the maximum pixel luminance is a first maximum pixel luminance, wherein the luminance of the light source is a first light source luminance and wherein the control circuit is further configured to;

select a second distribution factor that corresponds to a second maximum pixel luminance in a second region of the light modulation device based on the predetermined distribution factor function, wherein the second distribution factor is different from the first distribution factor;

calculate a second light source luminance of a second light source of the illumination system that is configured to illuminate the second region by applying the selected second distribution factor to the second maximum pixel luminance and calculate a second transmission of the light modulation device for an other pixel corresponding to the second maximum pixel luminance, and configure the second light source of the illumination device to output said second light source luminance of the second light source and configure the light modulation device to implement the calculated second transmission at the other pixel such that the second maximum pixel luminance is displayed at the second pixel.

13. The system of claim 11, wherein the applying the selected distribution factor to the maximum pixel luminance comprises scaling a contribution of the maximum pixel luminance to the luminance of the light source with the selected distribution factor.

14. The system of claim 11, wherein the calculation of the luminance of the light source and the function are configured such that the luminance of the light source increases with increasing values of the maximum pixel luminance for at least a subset of the plurality of distribution factors.

15. The system of claim 11, wherein the applying comprises applying the selected distribution factor as a power of a fraction of the maximum pixel luminance.

16. The system of claim 11, wherein the applying comprises applying the selected distribution factor as a power of Lr/Lp, wherein Lr is the maximum pixel luminance in said region of the light modulation device and wherein Lp is a maximum pixel luminance of all regions in the light modulation device.

17. The system of claim 11, wherein a majority of distribution factor variances in said function occur only for a subrange of pixel luminances displayable by the light source.

18. The system of claim 17, wherein a substantial majority of said pixel luminances displayable by the light source are outside of said subrange.

19. The system of claim 18, wherein said substantial majority of said pixel luminances is at least about 98% of said pixel luminances displayable by the light source.

20. A method for displaying image information in a display system comprising:

determining, from the image information, a maximum pixel luminance in a region of a light modulation device;

selecting a distribution factor, which corresponds to the maximum pixel luminance, based on a predetermined distribution factor function that associates a plurality of distribution factors with a plurality of pixel luminances;

calculating a luminance of a light source of an illumination device configured to illuminate the region of the light modulation device by applying the selected distribution factor to the maximum pixel luminance and calculating a transmission of the light modulation device for a pixel corresponding to the maximum pixel luminance, wherein the applying comprises applying the selected distribution factor as a power of a fraction of the maximum pixel luminance; and displaying the maximum pixel luminance at the pixel by configuring the light source of the illumination device to output said luminance of the light source and by configuring the light modulation device to implement the calculated transmission at the pixel.

21. The method of claim 20, wherein the applying comprises applying the selected distribution factor as the power of the fraction corresponding to Lr/Lp, wherein Lr is the maximum pixel luminance in said region of the light modulation device and wherein Lp is a maximum pixel luminance of all regions in the light modulation device.

22. The method of claim 20, wherein the applying comprises applying the selected distribution factor as the power of the fraction corresponding to $$\left(\frac{L_r}{L_p}\right)^a,$$

wherein Lr is the maximum pixel luminance in said region of the light modulation device, Lp is a maximum pixel luminance of all regions in the light modulation device, and a is the distribution factor.

23. A method for displaying image information in a display system comprising:

determining, from the image information, a maximum pixel luminance in a region of a light modulation device, wherein a light source of an illumination device is configured to illuminate the region of the light modulation device;

selecting a distribution factor, which corresponds to the maximum pixel luminance, based on a predetermined distribution factor function that associates a plurality of distribution factors with a plurality of pixel luminances, wherein a majority of distribution factor variances in said function occur only for a subrange of pixel luminances displayable by the light source;

calculating a luminance of the light source by applying the selected distribution factor to the maximum pixel luminance and calculating a transmission of the light modulation device for a pixel corresponding to the maximum pixel luminance; and displaying the maximum pixel luminance at the pixel by configuring the light source of the illumination device to output said luminance of the light source and by configuring the light modulation device to implement the calculated transmission at the pixel.

24. The method of claim 23, wherein a substantial majority of said pixel luminances displayable by the light source are outside of said subrange.

25. The method of claim 24, wherein said substantial majority of said pixel luminances is at least about 98% of said pixel luminances displayable by the light source.

26. A system for displaying image information comprising:

a light modulation device including a pixel region;

an illumination device including a light source that is configured to illuminate the pixel region of the light modulation device; and a control circuit configured to determine, from the image information, a maximum pixel luminance in the pixel region of the light modulation device, select a distribution factor, which corresponds to the maximum pixel luminance, based on a predetermined distribution factor function that associates a plurality of distribution factors with a plurality of pixel luminances, calculate a luminance of the light source by applying the selected distribution factor to the maximum pixel luminance and calculate a transmission of the light modulation device for a pixel corresponding to the maximum pixel luminance, wherein the applying comprises applying the selected distribution factor as a power of a fraction of the maximum pixel luminance, and configure the light source of the illumination device to output said luminance of the light source and configure the light modulation device to implement the calculated transmission at the pixel such that the maximum pixel luminance is displayed at the pixel.

27. The system of claim 26, wherein the applying comprises applying the selected distribution factor as the power of the fraction corresponding to Lr/Lp, wherein Lr is the maximum pixel luminance in said region of the light modulation device and wherein Lp is a maximum pixel luminance of all regions in the light modulation device.

28. The system of claim 26, wherein the applying comprises applying the selected distribution factor as the power of the fraction corresponding to $$\left(\frac{L_r}{L_p}\right)^a,$$

wherein Lr is the maximum pixel luminance in said region of the light modulation device, Lp is a maximum pixel luminance of all regions in the light modulation device, and a is the distribution factor.

29. A system for displaying image information comprising:

a light modulation device including a pixel region;

an illumination device including a light source that is configured to illuminate the pixel region of the light modulation device; and a control circuit configured to determine, from the image information, a maximum pixel luminance in the pixel region of the light modulation device, select a distribution factor, which corresponds to the maximum pixel luminance, based on a predetermined distribution factor function that associates a plurality of distribution factors with a plurality of pixel luminances, wherein a majority of distribution factor variances in said function occur only for a subrange of pixel luminances displayable by the light source, calculate a luminance of the light source by applying the selected distribution factor to the maximum pixel luminance and calculate a transmission of the light modulation device for a pixel corresponding to the maximum pixel luminance, and configure the light source of the illumination device to output said luminance of the light source and configure the light modulation device to implement the calculated transmission at the pixel such that the maximum pixel luminance is displayed at the pixel.

30. The system of claim 29, wherein a substantial majority of said pixel luminances displayable by the light source are outside of said subrange.

31. The system of claim 30, wherein said substantial majority of said pixel luminances is at least about 98% of said pixel luminances displayable by the light source.

* * * * *